United States Patent [19]

Altdorf

[11] Patent Number: 4,760,831

[45] Date of Patent: Aug. 2, 1988

[54] ADJUSTMENT MECHANISM FOR CHANGING DISCHARGE INITIATION AND TIMING OF AN INTERNAL COMBUSTION ENGINE

[75] Inventor: Joachim Altdorf, Cologne, Fed. Rep. of Germany

[73] Assignee: Kloeckner-Humboldt-Deutz AG, Fed. Rep. of Germany

[21] Appl. No.: 40,140

[22] Filed: Apr. 20, 1987

[30] Foreign Application Priority Data

Apr. 26, 1986 [DE] Fed. Rep. of Germany ..... 3614281

[51] Int. Cl.[4] ..... F02M 39/00

[52] U.S. Cl. ..... 123/501; 123/495; 123/504; 123/509; 417/218

[58] Field of Search ..... 123/509, 495, 500, 501, 123/504, 90.5, 90.16; 417/218

[56] References Cited

U.S. PATENT DOCUMENTS

| | | | |
|---|---|---|---|
| 2,070,933 | 2/1937 | Taylor | 123/504 |
| 3,040,723 | 6/1962 | Scherenberg | 123/501 |
| 3,079,904 | 3/1963 | Scibbe | 123/448 |
| 4,234,292 | 11/1980 | Berg | 417/218 |
| 4,335,685 | 6/1982 | Clouse | 123/90.5 |
| 4,531,496 | 7/1985 | Thomas | 123/495 |
| 4,617,903 | 10/1986 | Heberle | 123/501 |
| 4,625,700 | 12/1986 | Elsbett | 123/501 |

FOREIGN PATENT DOCUMENTS

| | | | |
|---|---|---|---|
| 0065353 | 11/1982 | European Pat. Off. | 123/495 |
| 0128970 | 7/1984 | Japan | 123/501 |
| 678026 | 8/1952 | United Kingdom | 123/501 |
| 1328096 | 8/1973 | United Kingdom | 123/501 |

*Primary Examiner*—Carl Stuart Miller

*Attorney, Agent, or Firm*—Charles L. Schwab

[57] ABSTRACT

An adjustment mechanism for changing the timing of fluid flow to or from the combustion chamber of an internal combustion engine wherein an axially displaceable support body 15 displaces a plunger 10 tangentially relative to a camshaft 2 which reciprocates the plunger 10.

15 Claims, 1 Drawing Sheet

ADJUSTMENT MECHANISM FOR CHANGING DISCHARGE INITIATION AND TIMING OF AN INTERNAL COMBUSTION ENGINE

TECHNICAL FIELD

This invention relates to an adjustment mechanism by which fuel injection initiation and timing may be changed. The mechanism may also be used to control the timing of intake and exhaust valves of an internal combustion engine.

PRIOR ART STATEMENT

British Patent No. 1 328 096 shows a discharge initiation adjustment mechanism for an in-line injection pump for an internal combustion engine, which is integrated into the casing of the in-line injection pump. A plunger between the push rod and the camshaft of the in-line injection pump is moved tangentially relative to the camshaft by a mechanism adjusted by two eccentrically supported adjustment rods, thereby changing initiation of discharge. The height of the in-line injection pump unit is increased because of the space required for the adjustment mechanism. In addition, the eccentrically supported adjustment rods which interact with the adjustment mechanism must be extremely accurate in their fabrication and must be aligned precisely to achieve trouble-free functioning. It is also necessary to provide the adjustment rods with suitable connecting levers in order to transfer a direction of rotation exerted on one adjustment rod to the second adjustment rod. It is also necessary to provide suitable supports in the casing of the in-line injection pump for the adjustment rods.

OBJECTS AND BRIEF DESCRIPTION OF THE INVENTION

The primary purpose of the invention is to provide an adjustment mechanism for a plunger of the type reciprocated by a cam in a direction radial to the shaft carrying the cam, whereby the plunger can be displaced tangentially with respect to the shaft and wherein the adjustment mechanism is mechanically simple, requires a minimal amount of space, and is problem-free when installed and used in an internal combustion engine.

The adjustment mechanism includes a support body which is supported on a stationary casing for shifting movement on an axis oblique to the direction of reciprocating movement of the plunger effected by the cam. A borehole is formed in the support body parallel to the axis of the direction of movement of the plunger and surrounds the plunger. A borehole for guiding the plunger may be formed in the casing of an internal combustion engine during fabrication of the casing with minimal additional expense because it is not anticipated that the basic engine casing will need to be otherwise modified to accommodate the installation of the adjustment mechanism of this invention. It is also possible, with little difficulty, to subsequently provide a previously fabricated internal combustion engine with an appropriate oblique borehole since the borehole which is already present in the engine need only be bored out at the desired angle. The adjustment mechanism, comprising mainly the support body, also does not present any particularly difficult fabrication technology-related requirements and can be fabricated with standard machine tools.

The support body may include an axially extending projection adapted for connection to a control member and this projection or axial extension may advantageously extend on one side of the camshaft in generally tangential relation to the cam without coming into contact with either the cam or the shaft. It is advantageous to fabricate this projection as an integral part or extension of the support body.

A recess may be formed on the side of the extension of the support body which is remote from the cam and a lug of an operating shaft may extend into the recess in an interlocking manner whereby pivotal movement of the control shaft causes axial shifting of the support body on its olique axis. The lug has a surface contour in the area thereof contacting the opposite walls of the groove in the extension, which produces a backlash-free engagement through a predetermined angle of rotation of the control shaft. This construction results in a simple control arrangement for axially adjusting one or more support bodies. The operating shaft is rotatably mounted on the casing parallel to the axis of the camshaft. For this, the bearing flanges, which are already available for mounting the camshaft, can be used to support the control shaft by drilling the necessary additional aligned holes in the already existing flanges.

The operating shaft may be turned by means of an appropriate lever which is operated by an adjusting piston. The adjusting piston can, for example, be adjusted during use of the adjustment mechanism as an injection initiation adjustment arrangement for an injection pump element of an internal combustion engine from one of the known compatible groups such as, for instance, load dependent injection initiation compatible groups, or load pressure dependent injection initiation groups. A variety of reliable components of this type are commercially available as, for example, those used with distributor injection pumps. In addition, it is possible in accordance with this invention to regulate the adjusting piston through central electronic control. The possible control alternatives can be chosen analogously when an adjustment mechanism of this invention is being used to alter the timing of intake and/or exhaust valves of an internal combustion engine.

The adjustment mechanism of this invention is particularly useful in the case of individual injection pump units which are inserted directly into the internal combustion engine casing. The adjustment mechanism is also suitable for installation in in-line injection pumps.

In order to prevent rotation of the plunger of the adjustment mechanism, pins carried by the plunger and the support body may interlock with appropriate grooves in the support body and casing.

As has already been described above, the adjustment mechanism of this invention can be used for the injection initiation of the injection pump elements of an internal combustion engine, as well as for modifying the timing of intake and exhaust valves. Depending on the use application, the intake and exhaust valves are adjusted alone or together by means of corresponding adjustment mechanisms.

BRIEF DESCRIPTION OF THE DRAWING

One embodiment of the invention is illustrated in the single drawing figure which is a section view of a fuel injection pump unit.

DETAILED DESCRIPTION OF THE DRAWING

Figure 1:
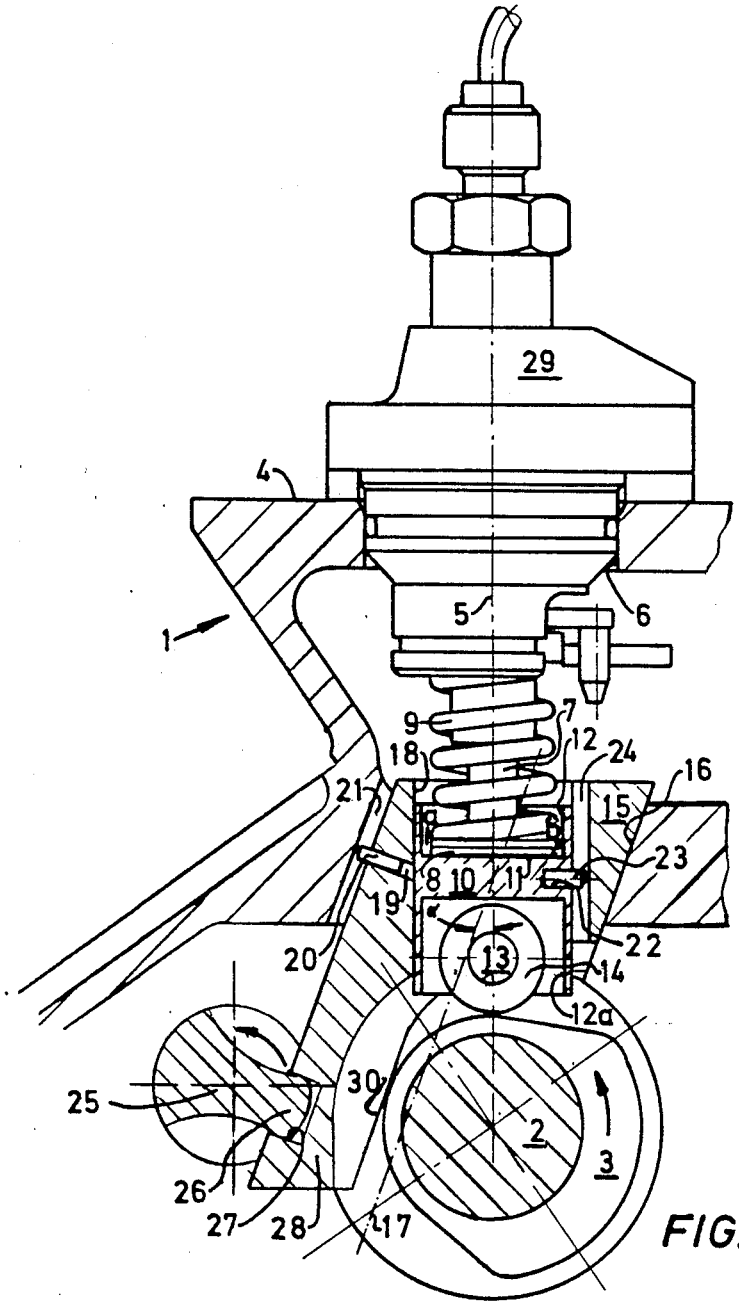

An internal combustion engine includes a casing 1 in which a longitudinally extending camshaft 2 is mounted. The camshaft actuates intake and exhaust valves and an injection pump unit 29 of the internal combustion engine by cams 3 which are positioned along the shaft. An injection pump unit 29 is secured to a flange 4 of the casing 1 by conventional fastening means, not shown. The flange 4 is parallel to the camshaft 2 and at right angles to the axis 5 of the push rod 7 of the injection pump 29. An opening 6 is formed in the flange 4, through which the push rod 7 of the injection pump unit 29 extends. The end of the push rod 7 nearest the camshaft 2 terminates in an annular end flange or end plate 8, upon which a compression spring 9 is supported, thereby biasing the push rod toward the camshaft 2. A cylindrical plunger 10 is positioned between the push rod 7 and the camshaft 2 with the axis of the plunger 10 parallel to the axis 5 of the push rod 7.

The plunger 10 has an interior transverse wall presenting a flat abutment surface 11 facing the push rod 7. The surface 11 is parallel to the end plate 8 and supports it. The clearance or gap intervals a and b between the outer diameter of plate 8 and the inner diameter of a pipe-like cylindrical projection 12, shaped as a circular ring-shaped projection of surface 11, is sufficiently great that neither is zero throughout the full tangential adjustment of the plunger 10 relative to the camshaft 2.

A pipe-like cylindrical projection **12*a* extends downwardly from the wall on which the surface 11 is formed in the direction toward the camshaft 2. A pair of aligned boreholes, not shown, are formed in the circular ring-shaped projection 12*a* for supporting a shaft 13 which supports a roller 14 disposed within the circular ring-shaped projection 12*a*. The roller 14 rotates about an axis parallel to the axis of the camshaft 2 and makes rolling contact with the circumferential surface of a cam 3 on the camshaft 2. As the camshaft 2 rotates, the cam 3 reciprocates the plunger 10 in the direction of the axis 5 of the push rod 7. The plunger 10 is guided in a borehole 18 in a support body 15, which in turn is guided in an oblique bore 16 in a wall or flange-like extension of the casing. The cylindrically shaped support body 15 is shiftable in the direction of its axis 17 which is oblique to and intersects the axis 5 at an angle $\nu$. The borehole 18 is parallel to the axis 5 and has an inner diameter corresponding to the outer diameter of the plunger 10. The support body 15 also presents a radial borehole 19, into which a guide element in the form of a pin 20 has been pressed. A free end of the pin 20 extends from the borehole 9 into a guide element in the form of an axially extending groove 21 formed in the borehole 16 parallel to the axis 17 of the latter. The interlocking engagement of the pin 20 with the groove 21 prevents rotation of the support body 15 in the bore 16 and at the same time permits axial reciprocation of the support body 15 on the axis 17. It is advantageous to fabricate the support body 15 as a cylindrical component, however, it could be shaped differently. It is also possible to use, instead of the pin 20 and groove 21, a pair of guide rails 30 slidingly engaging the base diameter circumference of the camshaft 2 on opposite lateral sides of the cam 3 to prevent rotation of the cylindrical support body 15. If the external contour of the support body 15** is not a circular shape, such as a rectangular outer contour, an anti-rotation arrangement can be eliminated since the support body is then guided in a rotation-free manner in an appropriately designed opening in the casing extension.

A radial "blind hole" borehole 22 is drilled in the plunger 10 in the area of the wall on which the surface 11 is formed. A guide element in the form of a pin 23 is inserted in the hole 22 and has a free end which extends into a guide element in the form of a longitudinal or axially extending groove 24 formed in the bore 16 of the support body 15 parallel to the axis 5. Thus, the plunger 10 is prevented from rotating relative to the support body 15 but is allowed to reciprocate in the direction of the axis 5.

The support body 15 is shiftable axially on the axis 17 by an operating shaft 25 having a motion transmitting element in the form of a molded lug 26 which fits in interlocking motion transmitting engagement with a motion transmitting element in the form of a notch 27 in a downward projection or extension 28 of the support body 15. The operating shaft 25 is parallel to the axis of the camshaft 2 and is provided with at least one lever, not shown, by which the operating shaft 25 is pivoted through a predetermined angle. This movement is effected by an adjusting piston, not shown, which is conventionally adjusted hydraulically by the controllable fluid pressure.

If the operating shaft 25 is moved, for example, to the left in the direction of the arrow, the support body 15 is shifted towards the flange 4. Because the support body is disposed at an acute angle $\nu$ to the axis 5, the plunger 10 is displaced tangentially relative to the camshaft 2, whereby the interval b is decreased and interval a is increased. If, at the same time, the camshaft 2 is rotated in the direction of the arrow, the shifting of the plunger 10 will advance the initiation of injection towards "early". Rotation of operating shaft 25 opposite to the direction of the arrow will result in retarding the initiation of injection towards "late" if the direction of rotation of the camshaft remains unchanged.

The embodiments of the invention in which an exclusive property or privilege is claimed are defined as follows:

1. In combination with a casing, a camshaft and a plunger mounted on said casing and reciprocated by a cam of said camshaft in a direction radial to said camshaft, an adjustment mechanism for displacing the plunger tangentially relative to said camshaft comprising:

a support body mounted on said casing for translational shifting movement on an oblique axis disposed at an acute angle to the direction of the reciprocative movement of said plunger effected by said cam, a borehole in said support body in surrounding and guiding relation to said plunger, said borehole being parallel to the diection of movement of said plunger and an operating component connected to said support body operable to shift the latter axially on said oblique axis thereby translationally displacing said plunger tangentially relative to said camshaft.

2. The combination of claim 1 wherein said support body includes a pprojection connected to said operating component by which said support body is moved axially on said oblique axis.

3. The combination of claim 2 wherein said projection is an axial extension of said support body and extends in generally tangential relation to said camshaft in radially confronting relation to said cam without contacting said camshaft.

4. The combination of claim 3 and further comprising a recess formed in said projection on a side thereof remote from said cam wherein said operating component comprises and an operating shaft pivotally mounted on said casing and presenting a lug extending into said recess and operative to engage opposite sides of said recess in backlash-free contact throughout a predetermined angle of pivotal movement of said control shaft.

5. The combination of claim 4 and further comprising an annular opening in said casing defined by a cylindrical surface surrounding said support body and guiding the shifting movement of the latter on said oblique axis, a groove in said cylindrical surface parallel to said oblique axis and a guide element on said support body extending radially outward thereof and into said groove whereby said support body is prevented from rotating relative to said casing.

6. The combination of claim 5 wherein said borehole presents a longitudinal groove and said plunger includes a guide part in cooperative engagement with said longitudinal groove whereby said plunger is prevented from rotating relative to said support body.

7. The combination of claim 6 wherein said plunger operates a fuel injection pump.

8. The combination of claim 7 wherein said adjustment mechanism is operable to modify the timing of fuel flow in an internal combustion engine.

9. The combination of claim 1 wherein said operating component comprises an operating shaft mounted on said casing parallel to said camshaft for rotation through a predetermined angle and motion transmitting elements on said operating shaft and support body in motion transmitting engagement with one another and operable upon rotation of said operating shaft to shift said support body on said oblique axis thereby shifting said plunger tangentially in relation to said camshaft.

10. The combination of claim 1 and further comprising guide elements on said plunger and support body in cooperative engagement with one another and operative to prevent relative rotation between said plunger and support body.

11. The combination of claim 1 and further comprising guide elements on said casing and support body in cooperative engagement with one another and operative to prevent relative rotation between said casing and support body and to permit shifting movement of said support body relative to said casing in the direction of said oblique axis.

12. The combination of claim 11 and further comprising an operating shaft mounted on said casing parallel to said camshaft for rotation through a predetermined angle and motion transmitting elements on said operating shaft and support body in motion transmitting engagement with one another for translating rotary motion of said camshaft to axial movement of said support body.

13. A fuel injection pump for an internal combustion engine comprising:

a casing, a plunger mounted on said casing for reciprocation on a plunger axis, a camshaft rotatably mounted on said casing on a camshaft axis transverse to said plunge axis and having a cam which reciprocates said plunger on said plunger axis upon rotation of said camshaft and an adjustment mechanism for translationally moving said plunger transverse to its axis and tangentially relative to said camshaft including a support body mounted on said casing for shifting movement on an oblique axis disposed at an acute angle to said plunger axis and lying in a plane at right angles to said camshaft axis, a borehole in said support body in surrounding and guiding relation to said plunger, said borehole being parallel to the direction of movement of said plunger, and an operating component connected to said support body operable to shift said support body on said oblique axis.

14. The fuel pump of claim 13 wherein said support body includes an axial extension connected to said operating component and extending in generally tangential relation to said shaft in radially confronting relation to said cam without contacting said camshaft.

15. The fuel pump of claim 13 and further comprising an operating shaft pivotally mounted on said casing parallel to said camshaft and interlocking motion transmitting elements on said operating shaft and axial extension operable to shift said support body in the direction of said oblique axis upon rotation of said operating shaft through a predetermined angle whereby the timing of the initiation of fuel injection is altered.

* * * * *

UNITED STATES PATENT OFFICE

CERTIFICATE OF CORRECTION

Patent No. 4,760,831 Dated August 2, 1988

Inventor(s) Joachim Altdorf

It is certified that error appears in the above-identified patent and that said Letters Patent are hereby corrected as shown below:

Col. 4, line 63, cancel "pprojection" and substitute --- projection ---;

Col. 5, line 5, after "cam" insert --- and ---;
line 6, cancel "and".

Signed and Sealed this

Twenty-ninth Day of November, 1988

*Attest:*

DONALD J. QUIGG

*Attesting Officer*

*Commissioner of Patents and Trademarks*